US007604366B1

(12) United States Patent
Chen

(10) Patent No.: US 7,604,366 B1
(45) Date of Patent: Oct. 20, 2009

(54) PORTABLE READING LAMP

(75) Inventor: Chien-Cheng Chen, Miaoli (TW)

(73) Assignee: Lionbrook Technology Ltd., Miaoli, Miaoli County (TW)

( * ) Notice: Subject to any disclaimer, the term of this patent is extended or adjusted under 35 U.S.C. 154(b) by 0 days.

(21) Appl. No.: 12/141,750

(22) Filed: Jun. 18, 2008

(51) Int. Cl.
*F21V 33/00* (2006.01)

(52) U.S. Cl. ..... 362/99; 362/184; 362/196; 362/221; 362/225; 362/249.02; 362/249.05; 362/259; 362/800

(58) Field of Classification Search ..... 362/98, 362/99, 183, 184, 196, 221, 225, 249.02, 362/249.05, 259, 800
See application file for complete search history.

(56) References Cited

U.S. PATENT DOCUMENTS 6,241,360 B1 * 6/2001 Merrell ..... 362/99
7,198,382 B2 * 4/2007 Donovan ..... 362/184

* cited by examiner

*Primary Examiner*—Stephen F Husar
(74) *Attorney, Agent, or Firm*—Rabin & Berdo, PC

(57) ABSTRACT

A portable reading lamp includes a lower and an upper cover assembled together to enclose therein a printed circuit board (PCB), a plurality of light-emitting units, a laser-illuminating unit, a power supply unit, and switches for switching on and off the light-emitting units and the laser-illuminating unit. The assembled lower and upper covers define an inward curved front surface, from where the light-emitting units irradiate light onto a predetermined area to help in reading at a dark place without the need of a light-guiding plate, enabling a largely reduce size of the portable reading lamp. With the laser-illuminating unit, the portable reading lamp may serve as a laser pointer. And, magnets may be externally attached a bottom of the lower cover, enabling the portable reading lamp to serve as a magnetic memo holder.

13 Claims, 12 Drawing Sheets

PORTABLE READING LAMP

FIELD OF THE INVENTION

The present invention relates to a portable reading lamp usable at night or in a dark place. The portable reading lamp includes a printed circuit board (PCB) with a specific circuit layout and a plurality of light-emitting units electrically connected to the PCB. An upper cover and a lower cover are assembled together to enclose the PCB therebetween and define a front surface formed into an inward curved lighting surface, from where the light-emitting units collectively project light to a predetermined area without the need of using a light-guiding plate, enabling the portable reading lamp to have a minimized volume and be conveniently carried for use at different places.

BACKGROUND OF THE INVENTION

FIGS. 1 and 2 are assembled and exploded perspective views, respectively, of a conventional portable reading lamp 10. The portable reading lamp 10 includes a circuit board 20 on which plurality of light-emitting diode (LED) lights 21 are mounted. A positive electrode plate 22 and a negative electrode plate 23 are separately disposed at two ends of the circuit board 20 to connect to batteries. In addition, a switch mechanism 24 is arranged on the circuit board 20 for turning on/off the LED lights 21. A lower cover 30 and an upper cover 40 are assembled to each other to enclose the circuit board 20 therebetween. The lower cover 30 is located below the circuit board 20, and is formed at a bottom with a rectangular opening, via which the batteries can be moved into and out of the lower cover 30. A cover plate (not shown) having a shape corresponding to that of the rectangular opening is connected to the lower casing 30 for openably closing the rectangular opening. The lower cover 30 is further formed with a through hole, via which the switch mechanism 24 is partially exposed to an outer side of the lamp 10. In addition, a first long cut 31 is formed along an upper front edge of the lower cover 30 corresponding to a surface, from where the LEDs irradiate light. The upper cover 40 is assembled to a top of the lower casing 30, and is internally provided with locating members (not shown) for holding the circuit board 20, the positive and negative electrode plates 22, 23, and the switch mechanism 24 in place. A second long cut 41 is formed along a lower front edge of the upper cover 40. The first and the second long cut 31, 41 together define an elongated slot. The portable reading lamp 10 further includes a light-guiding plate 50 having a transparent plate 51 extended in a direction parallel to the lighting direction of the LED lights 20. The transparent plate 51 has a first edge inserted into the elongated slot defined by the long cuts 31, 41 to thereby assemble to the lower and upper covers 30, 40. A support strip 52 is mounted to a second edge of the transparent plate 51 opposite to the first edge in order to keep the transparent plate 51 in a horizontal state. Referring to FIG. 3, to use the portable reading lamp 10, first position the portable reading lamp 10 on a book or the like, and then switch on the LED lights 20 via the switch mechanism 24. At this point, light emitted from the LED lights 20 are projected into and transmitted along the light-guiding plate 50 to uniformly illuminate the book for reading.

The above conventional portable reading lamp 10 has the following disadvantages:

First, the light-guiding plate 50 is needed and must be extended in a direction parallel to the lighting direction of the LED lights 21, forming a limit in using the portable reading lamp 10;

Second, the light-guiding plate 50 is likely to reflect light projected thereto and causes discomfort to a user's eyes;

Third, the light-guiding plate 50 is subject to abrasion and scratches to form a scratched surface, which would cause degraded illumination quality to harm the user's vision; and Fourth, with the existence of light-guiding plate 50, the portable reading lamp 10 is considerably large in size, making the lamp 10 inconvenient for carrying or storing.

SUMMARY OF THE INVENTION

A primary object of the present invention is to provide a portable reading lamp that omits the conventional light-guiding plate to have a largely reduced size and can therefore be conveniently carried about for use at night or in a dark place.

Another object of the present invention is to provide a portable reading lamp having a front surface formed into an inward curved lighting surface, so that light irradiated by the lamp is concentrated in a predetermined area to provide enhanced illumination, and the portable reading lamp can be easily held without the risk of slipping off from a user's hand.

A further object of the present invention is to provide a portable reading lamp that can also be used as a laser pointer.

A still further object of the present invention is to provide a portable reading lamp that may be magnetically attached to a whiteboard or a metal surface on a domestic electric appliance for use as a magnetic memo holder in daily life or in working.

To achieve the above and other objects, the portable reading lamp of the present invention includes a printed circuit board (PCB) with a predetermined circuit layout provided thereon; a lower cover located below the PCB; an upper cover assembled to a top of the lower cover to enclose the PCB in and between the lower and the upper cover; a plurality of light-emitting units spaced on one side of the PCB to electrically connected to the circuit board; and a switch unit and a power supply unit provided on the PCB to electrically connect to each other. The lower cover has an elongated configuration with two long sides thereof formed into two concaved surfaces and is internally provided with fixing members for fixing the PCB to an inner side of the lower cover. The upper cover also has an elongated configuration corresponding to that of the lower cover and is formed with a plurality of holes corresponding to the light-emitting units as well as two opposite slits corresponding to the switch unit, such that the light-emitting units are respectively aligned with and confined in one corresponding hole and the switch unit is aligned with and fitted between the two slits. Also, the assembled upper cover and lower cover together define a front surface formed into an inward curved lighting surface, from where the light-emitting units irradiate light onto a predetermined area.

In an operable embodiment of the portable reading lamp, the inward curved lighting surface is a concaved surface of about 2 to 5 degrees.

In the operable embodiment of the portable reading lamp, the switch unit is composed of an adjustable switch and a disk assembled to the adjustable switch with a screw, and the two slits formed on the upper cover are two symmetrical curved slits corresponding to the disk.

In the operable embodiment of the portable reading lamp, the light-emitting units are LEDs.

In the operable embodiment of the portable reading lamp, the power supply unit includes two leaf springs in contact with a plurality of batteries, and the upper cover is formed on an inner surface near two ends thereof with two narrow recesses, such that the two leaf springs are separately fixedly inserted into the two narrow recesses.

In the operable embodiment of the portable reading lamp, the lower cover is internally provided with a partition plate to separate the PCB from the batteries, and the upper cover is internally provided with a retaining plate extended between the two narrow recesses, such that the partition plate and the retaining plate together define a battery compartment between them for receiving the batteries therein.

In the operable embodiment of the portable reading lamp, the lower cover is formed at a bottom with an opening, via which the batteries can be moved into and out of the battery compartment; and a cover plate having a size corresponding to that of the opening is connected to the lower cover to openably close the opening.

In the operable embodiment of the portable reading lamp, the power supply unit is a rechargeable power supply.

In the operable embodiment of the present invention, the portable reading lamp further includes a laser-illuminating unit electrically connected to the PCB and a switch assembly for switching on/off the laser-illuminating unit. The laser-illuminating unit and the switch assembly are arranged at an end of the PCB opposite to the switch unit, and the upper cover is formed with fixing holes corresponding to the laser-illuminating unit and the switch assembly, such that the laser illuminating unit and the switch assembly are separately aligned with and confined in the fixing holes.

In the operable embodiment of the portable reading lamp, the switch assembly is composed of a push switch and a push button.

In the operable embodiment of the portable reading lamp, the push button includes a key in the form of a circular boss and a plurality of radially outward extended and beveled locating teeth spaced around the key, and the locating teeth prevent the push button from angularly displacing when the key is downward pushed.

In the operable embodiment of the portable reading lamp, the laser-illuminating unit is a laser diode.

In the operable embodiment of the portable reading lamp, the lower cover is provided on an underside of its bottom near two ends thereof with a magnet each.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
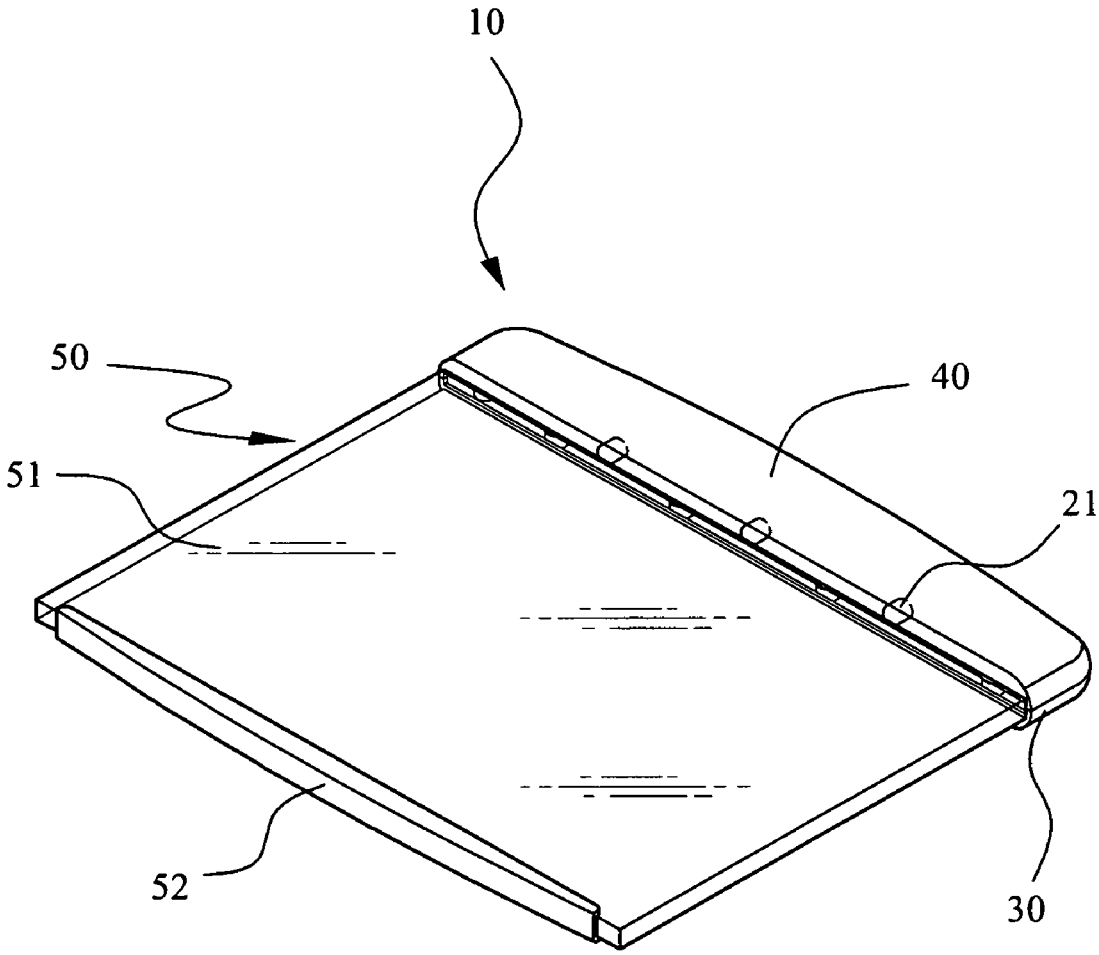
FIG. 1 (Prior Art)
FIG. 1 is an assembled perspective view of a conventional portable reading lamp.
Figure 2:
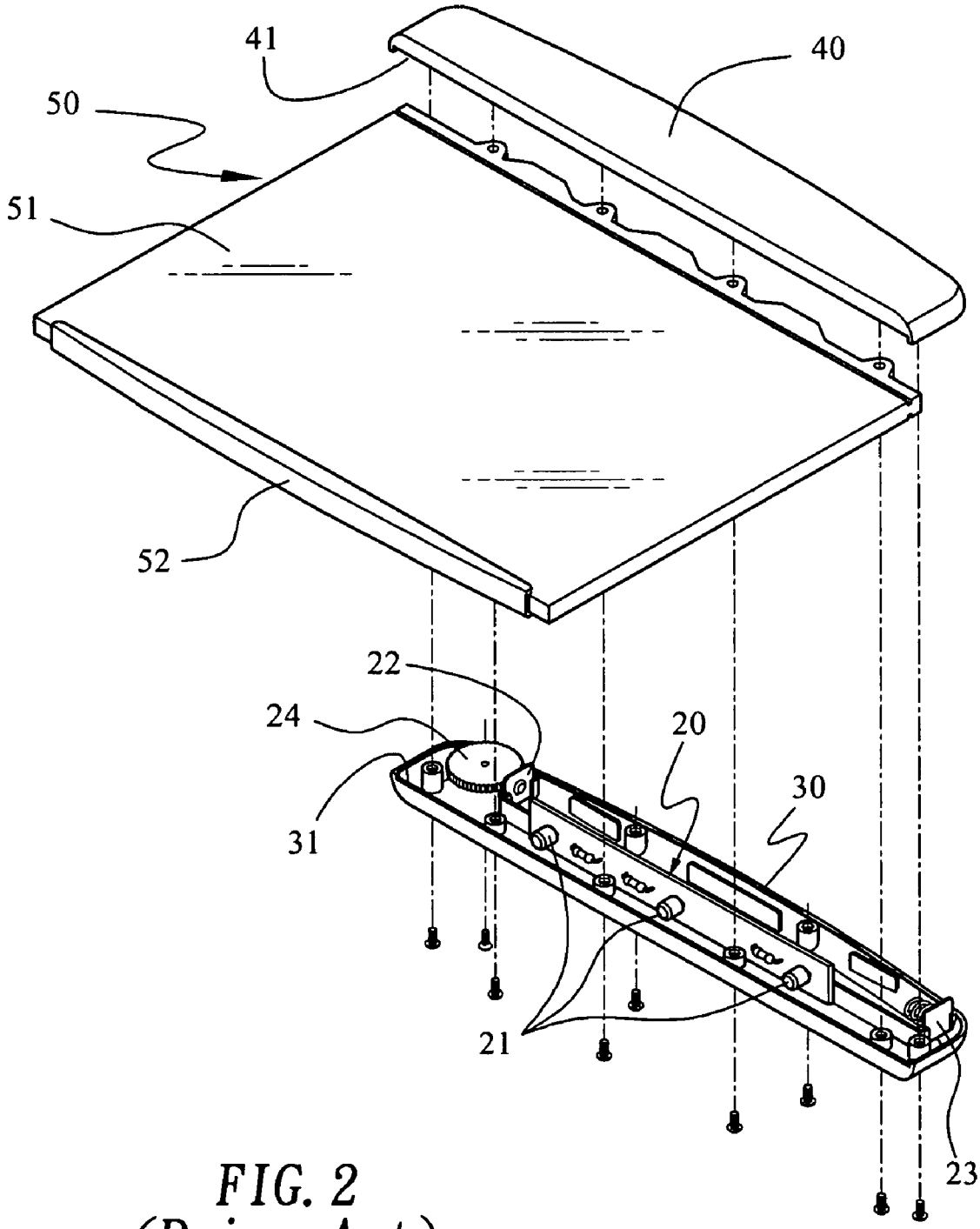
FIG. 2 (Prior Art)
FIG. 2 is an exploded perspective view of the conventional portable reading lamp of FIG. 1.
Figure 3:
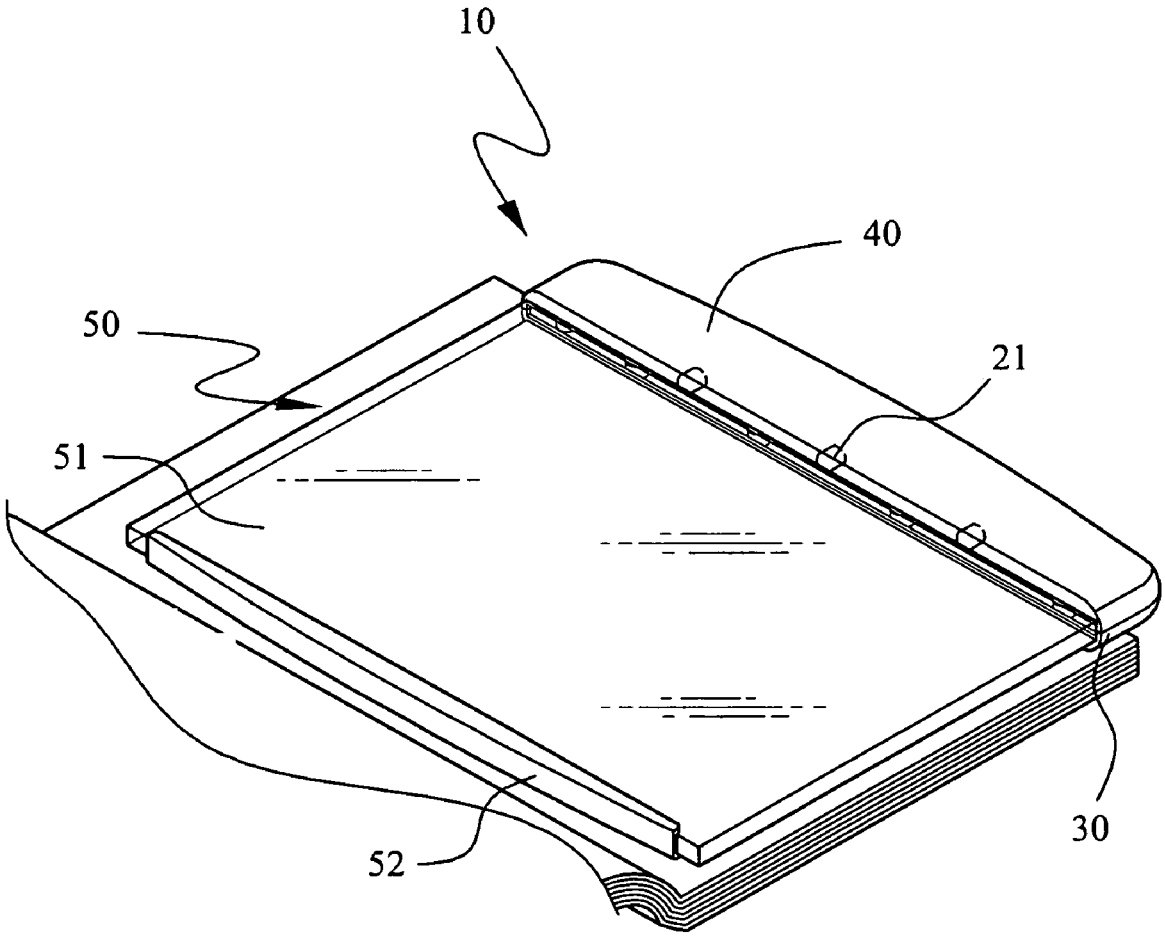
FIG. 3 (Prior Art)
FIG. 3 is a perspective view showing the use of the conventional portable reading lamp of FIG. 1 to illuminate a book for reading.
Figure 4:
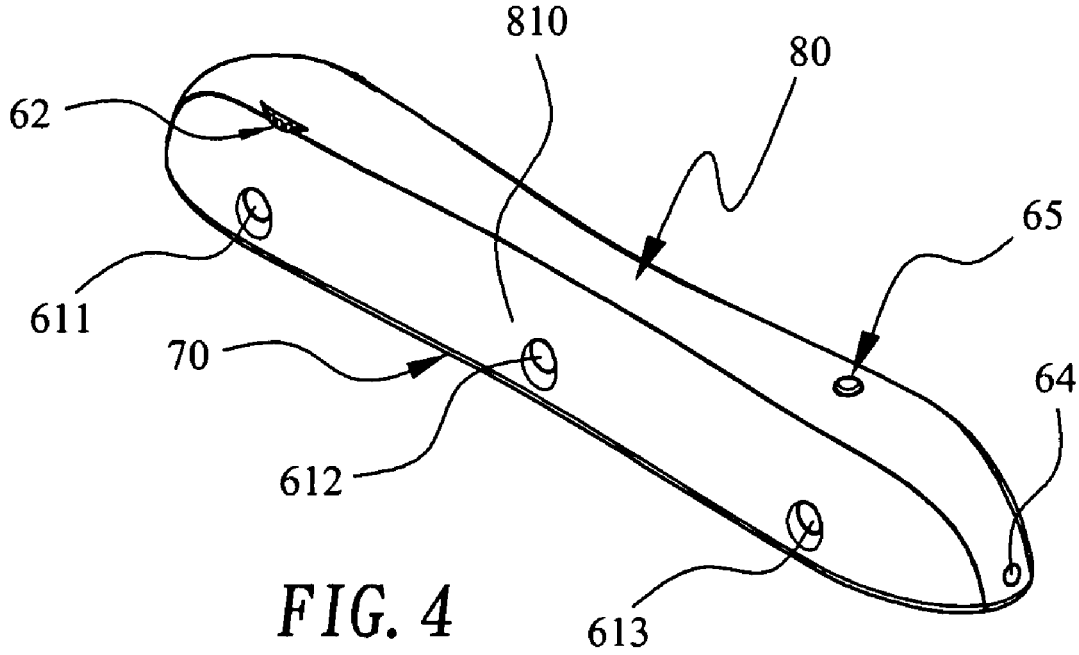
FIG. 4 is an assembled top perspective view of a portable reading lamp according to a preferred embodiment of the present invention.
Figure 5:
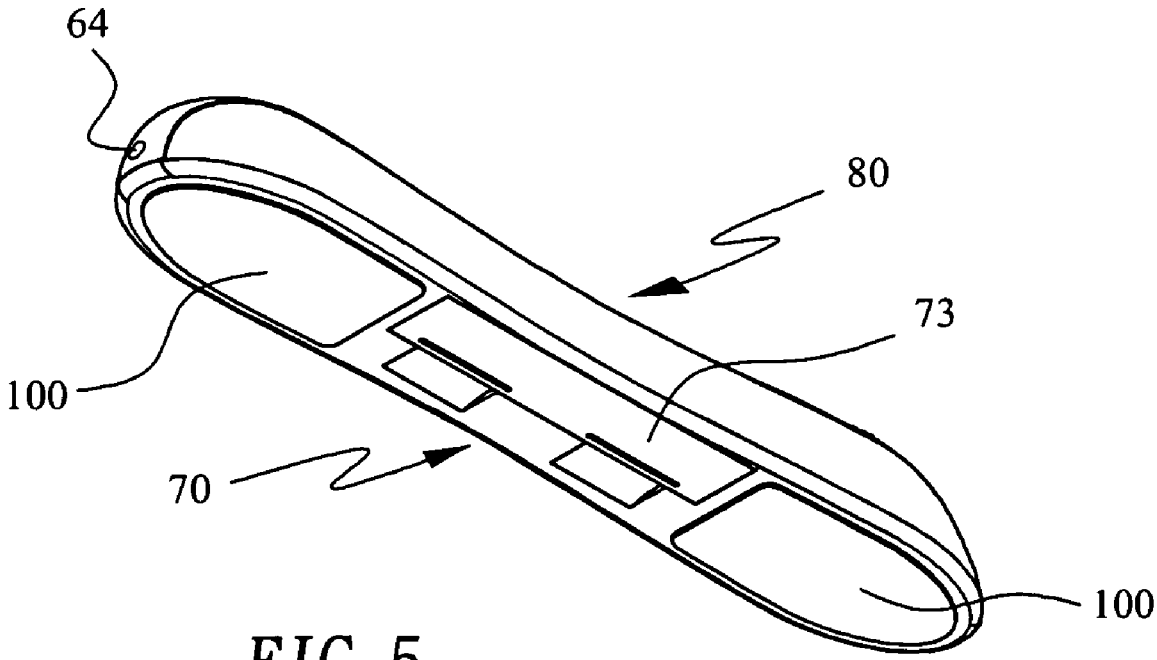
FIG. 5 is a bottom perspective view of FIG. 4.
Figure 6:
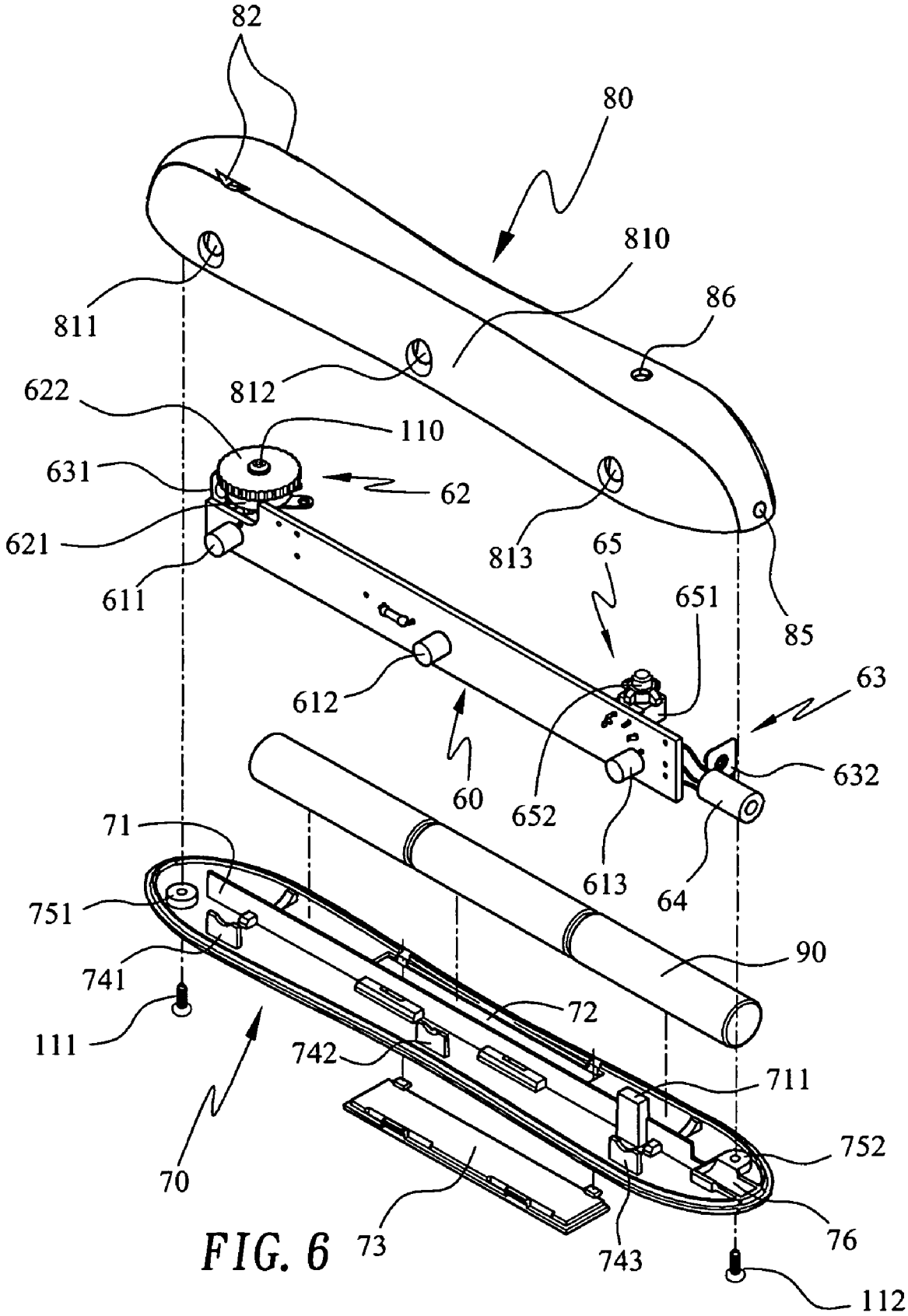
FIG. 6 is an exploded view of FIG. 4.

Please refer to FIGS. 4 to 6, in which a portable reading lamp according to a preferred embodiment of the present invention is shown. As shown, the portable reading lamp of the present invention includes a printed circuit board (PCB) 60 with a specific circuit layout provided thereon, a lower cover 70 located below the PCB 60, and an upper cover 80 assembled to a top of the lower cover 70 to enclose the PCB 60 in a space defined between the lower cover 70 and the upper cover 80.

A plurality of light-emitting units 611, 612, 613 is arranged on one side of the PCB 60 to electrically connect to the PCB 60. In addition, a switch unit 62 and a power supply unit 63 are provided on the PCB 60 at a predetermined position to electrically connect to each other. The lower cover 70 has an elongated configuration with two concaved long sides, and is internally provided with fixing members for fixing the PCB 60 to an inner side of the lower cover 70. The upper cover 80 also has an elongated configuration corresponding to that of the lower cover 70, and is formed with a plurality of holes 811, 812, 813 corresponding to the light-emitting units 611, 612, 613 and two opposite slits 82 corresponding to the switch unit 62, such that the light-emitting units 611, 612, 613 and the switch unit 62 are aligned with and confined in corresponding holes 811, 812, 813 and slits 82, respectively.

Figure 7:
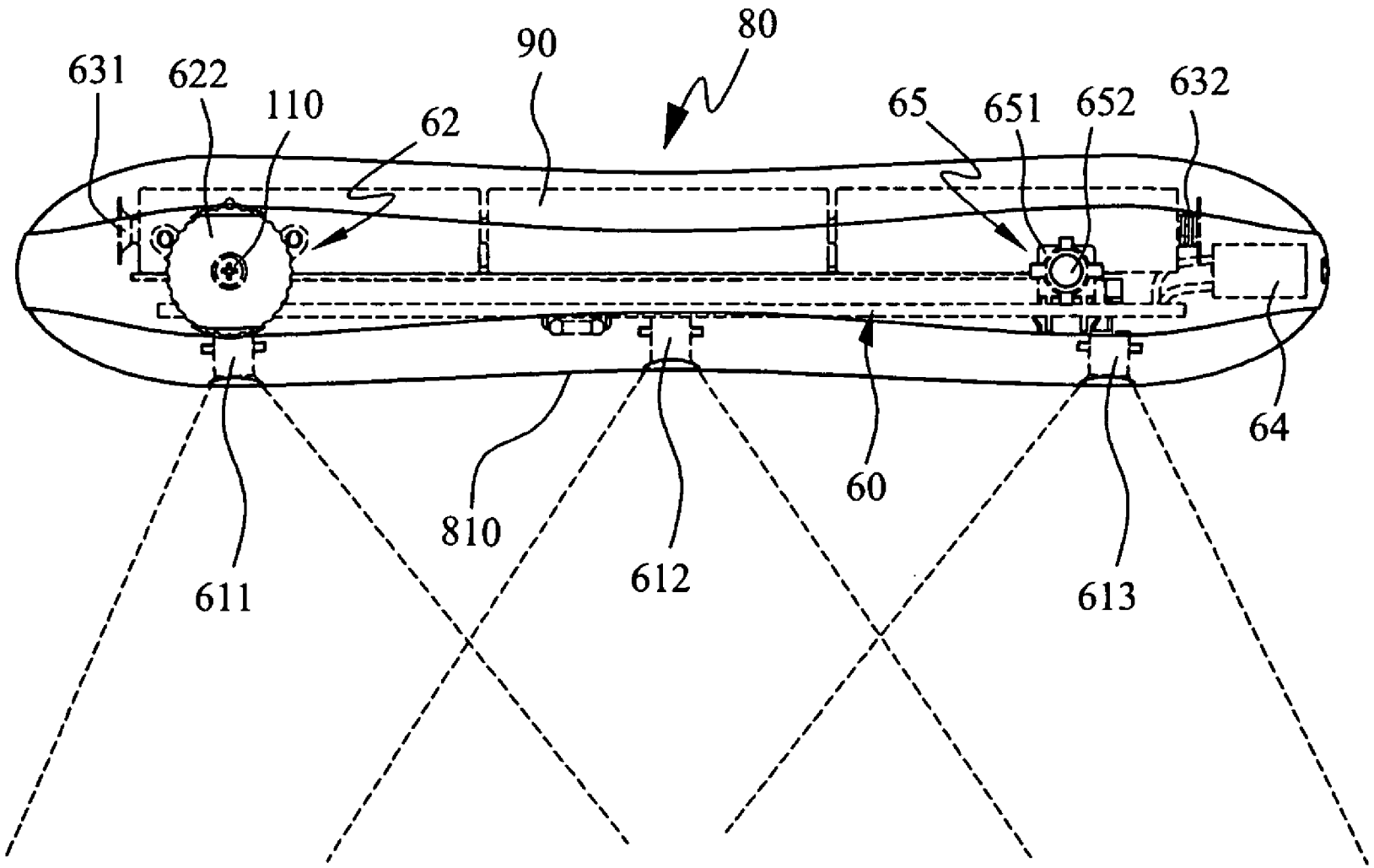
FIG. 7 is a top view of the portable reading lamp of the present invention showing how the light-emitting units thereof irradiate light.

Referring to FIG. 7, the assembled upper cover 80 and lower cover 70 together define a front surface formed into an inward curved lighting surface 810, from where the light-emitting units 611, 612, 613 collectively project light to a predetermined area having a predetermined size. In a preferred embodiment, the inward curved lighting surface 810 is a concaved surface of about 2 to 5 degrees.

In a preferred embodiment, the switch unit 62 is composed of an adjustable switch 621 and a disk 622 assembled to the adjustable switch 621 with a screw. The slits 82 on the upper cover 80 are two symmetrical curved slits corresponding to the disk 622.

Preferably, the light-emitting units 611, 612, 613 are light-emitting diodes (LEDs).

Figure 8:
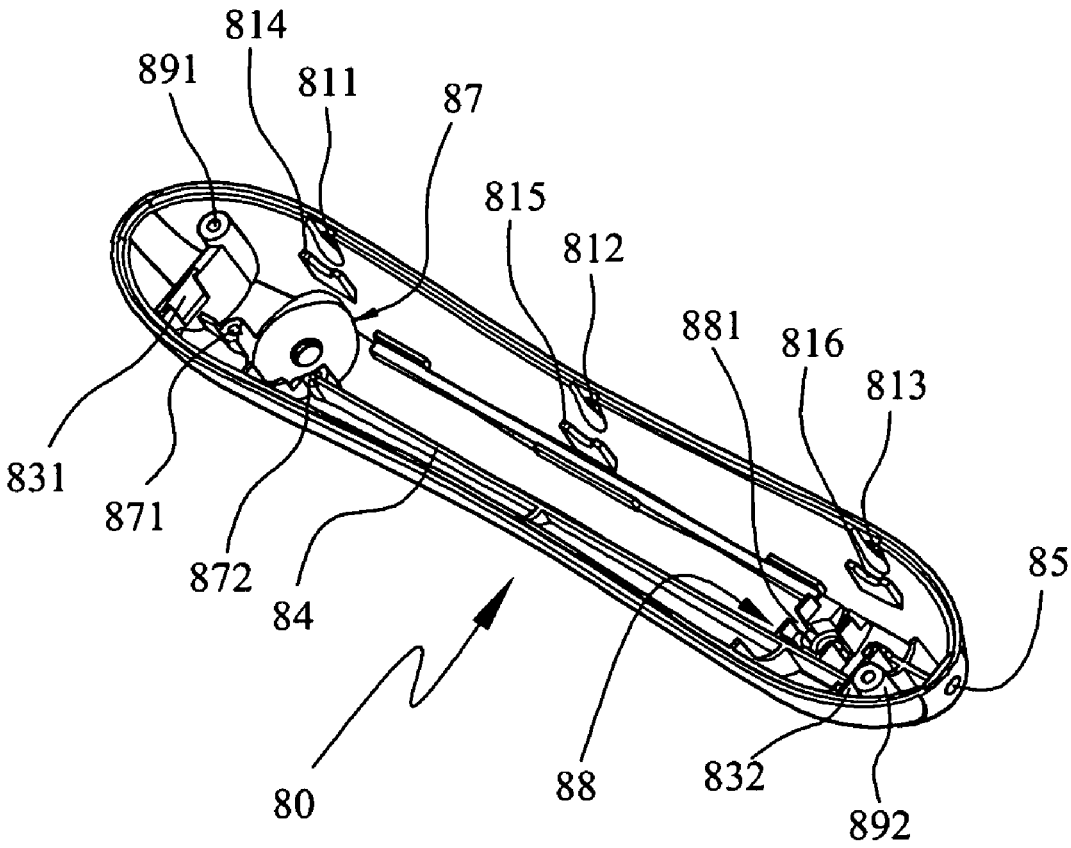
FIG. 8 is a bottom perspective view of an upper cover for the portable reading lamp of the present invention.

Please refer to FIGS. 6 and 8. In an operable preferred embodiment, the power supply unit 63 includes two leaf springs 631, 632 in contact with a plurality of batteries 90. Two narrow recesses 831, 832 are provided in the upper cover 80 near two ends thereof for the leaf springs 631, 632 to fixedly insert thereinto. The lower cover 70 is internally provided with a partition plate 71 for separating the PCB 60 from the batteries 90. The upper cover 80 is internally provided with a retaining plate 84 extended between the two narrow recesses 831 and 832, such that the partition plate 71 and the retaining plate 84 together define a battery compartment between them for stably receiving the batteries 90 therein. In the illustrated embodiment, the lower cover 70 is formed at a bottom with an opening 72, via which the batteries 90 can be moved into and out of the battery compartment. And, a cover plate 73 having a size corresponding to that of the opening 72 is connected to the lower cover 70 for openably closing the opening 72. It is understood that the power supply unit 63 may be designed according to different requirements in use. For example, the power supply unit 63 may be a built-in rechargeable battery, an externally connected USB charging structure, or a car-type charging structure for in-car usage.

According to another operable preferred embodiment, the portable reading lamp of the present invention further includes a laser-illuminating unit 64 electrically connected to the PCB 60 and a switch assembly 65 for switching on/off the laser-illuminating unit 64. The laser-illuminating unit 64 and the switch assembly 65 are located at one end of the PCB 60 opposite to the switch unit 62. The upper cover 80 is formed with fixing holes 85 and 86 corresponding to the laser illuminating unit 64 and the switch assembly 65, such that the laser illuminating unit 64 and the switch assembly 65 are aligned with and confined in the fixing holes 85 and 86, respectively. In a preferred embodiment, the switch assembly 65 is composed of a push switch 651 and a push button 652, and the laser-illuminating unit 64 is a laser diode.

Figure 9:
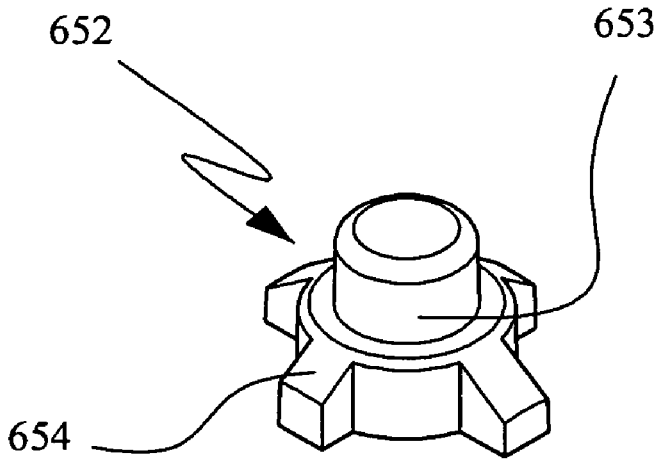
FIG. 9 is a perspective view of a push button for the portable reading lamp of the present invention.

Please refer to FIG. 9. In the illustrated preferred embodiment, the push button 652 includes a key 653 in the form of a circular boss and a plurality of radially outward extended and beveled locating teeth 654 spaced around the key 653. The locating teeth 654 prevent the push button 652 from angularly displacing and becoming stuck in the fixing hole 86 when the key 653 is downward pushed.

In another operable preferred embodiment, two magnets 100 are externally attached to the bottom of the lower cover 70 near two ends thereof, enabling the portable reading lamp to be magnetically attached to a magnetically attractable surface, such as a whiteboard, a metal surface on a domestic electric appliance, etc.

Figure 10:
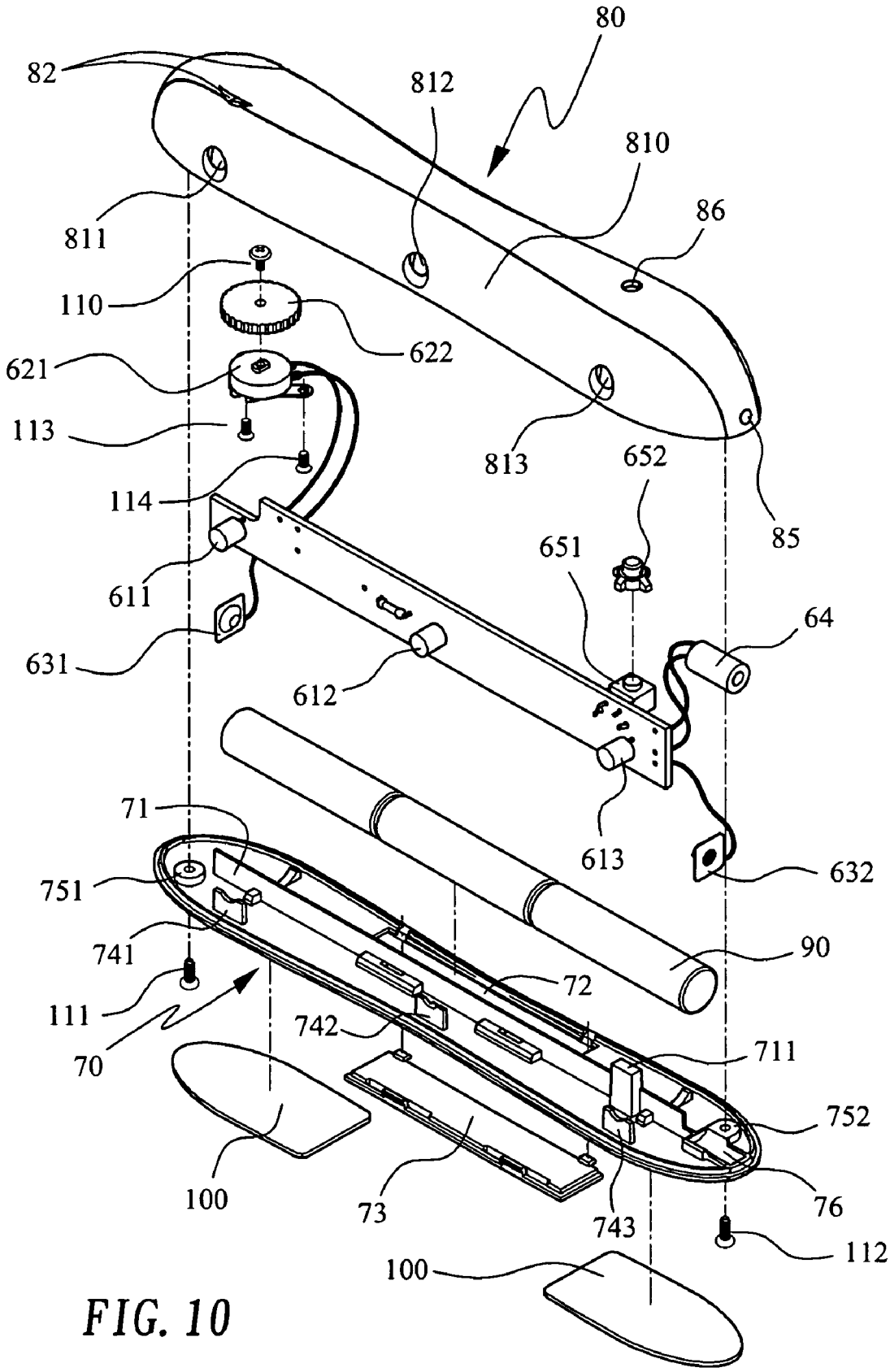
FIG. 10 is a further exploded perspective view of the portable reading lamp of FIG. 6.

Please refer to FIG. 10 that is a further exploded perspective view of FIG. 6. As shown in the illustrated preferred embodiment of the present invention, three light-emitting units 611, 612, and 613 are provided along one side of the PCB 60 to irradiate light from the concaved light surface 810. Wherein, the middle light-emitting unit 612 irradiates light in a direction normal to the PCB 60 while the other two lateral light-emitting units 611 and 613 irradiate light in a direction inward deviated from a normal line of the PCB 60 by about 2 to 5 degrees. The adjustable switch 621 is disposed atop one end of the PCB 60. The disk 622 is assembled to the top of the adjustable switch 621 by means of a first screw 110 to complete the switch unit 62 for switching on and off for the light-emitting units 611, 612, 613. The push switch 651 is mounted to an upper side of the PCB 60 near the other end thereof opposite to the switch unit 62. The push button 652 is assembled to a top of the push switch 651 to complete the switch assembly 65 for switching on and off for the laser-illuminating unit 64. Meanwhile, the two leaf springs 631 and 632 are located at two opposite ends of the PCB 60.

The fixing members internally formed on the lower cover 70 hold the PCB 60 in place. The partition plate 71 is located along a central line of the lower cover 70 to separate the PCB 60 from the batteries 90. The partition plate 71 is provided with an upward projected block 711, against which the push switch 651 presses. In addition, three locating plates 741, 742, and 743 are arranged along and spaced from one side of the partition plate 71 for fixedly supporting the three light-emitting units 611, 612, and 613 thereon. The opening 72 is formed on the bottom of the lower cover 70 at the other opposite side of the partition plate 71 to allow mounting and removing of the batteries 90 to and from the portable reading lamp and the cover plate 73 openably closes the opening 72. Two first threaded holes 751 and 752 are separately formed in and near two ends of the lower cover 70 and a mounting recess 76 is also formed on the lower cover 70 for the laser-illuminating unit 64 to locate therein. And, the two magnets 100 are attached to an underside of the bottom of the lower cover 70 near two opposite ends thereof.

Referring to FIGS. 8 and 10, two screws 111 and 112 are separately upward extended through the first threaded holes 751 and 752 to fixedly connect the lower cover 70 to the upper cover 80. A circular stepped sink 87 is formed on the inner surface of the upper cover 80 for receiving the switch unit 62 therein. The two slits 82 are formed on the upper cover 80 at two diametrically opposite sides of the sink 87. In addition, two threaded mounting holes 871 and 872 are formed at two sides of the sink 87. The switch unit 62 is mounted to the upper cover 80 by two pieces of screws 113 and 114 upward extended through the adjustable switch 621 into the two threaded mounting holes 871 and 872 with the disk 622 partially protruded from the upper cover 80 via the two slits 82. A stepped locating recess 88 is also formed on the inner surface of the upper cover 80 for receiving the push switch 651 and the push button 652 of the switch assembly 65 therein. The stepped locating recess 88 includes a central fixing hole 86 for receiving the push button 652 therein, and a plurality of notches 881 spaced along the central fixing hole 86 for fitly engaging with the locating teeth 654, so that the push button 652 is prevented from angularly displacing when being downward pushed. In addition, the upper cover 80 is formed at a position corresponding to the laser-illuminating unit 64 with the fixing hole 85. The upper cover 80 further has three locating plates 814, 815, and 816, which cooperate with the locating plates 741, 742, and 743 on the lower cover 70 to hold the light-emitting units 611, 612, and 613 in place, so that the light-emitting units 611, 612, and 613 are aligned with the holes 811, 812, and 813 to irradiate light. Two second threaded holes 891 and 892 are separately formed in the upper cover 80 near two ends thereof. The second screws 111 and 112 are upward extended through the first thread holes 751 and 752 into the second threaded holes 891 and 892 to lock the lower cover 70 to the upper cover 80. And, as having been described above, the retaining plate 84 extended between the two narrow recesses 831 and 832 on the upper cover 80 cooperate with the partition plate 71 on the lower cover 70 to define a battery compartment between them for stably receiving the batteries 90 therein.

Figure 11:
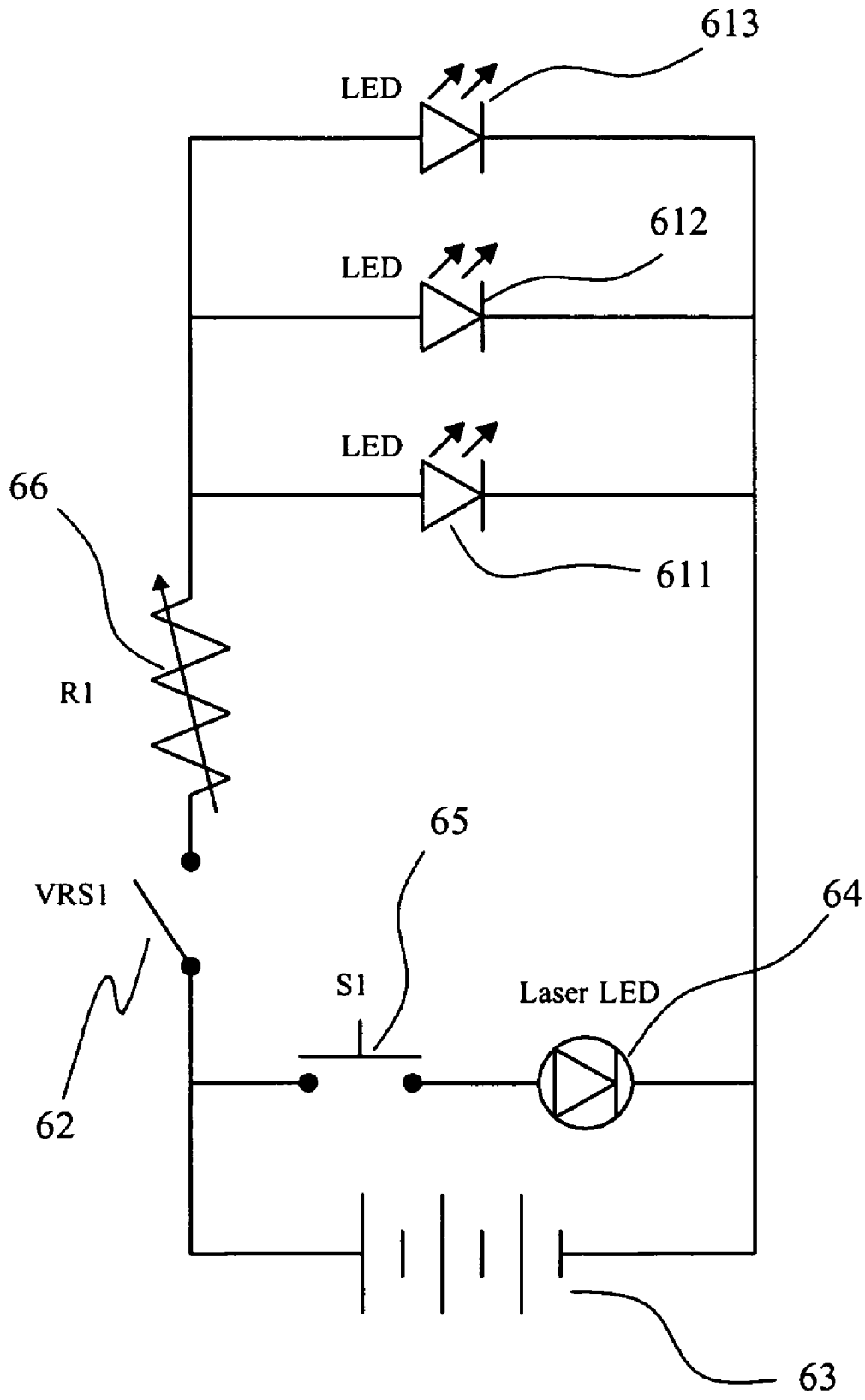
FIG. 11 is a circuit diagram for an operable embodiment of the present invention.
Figure 12:
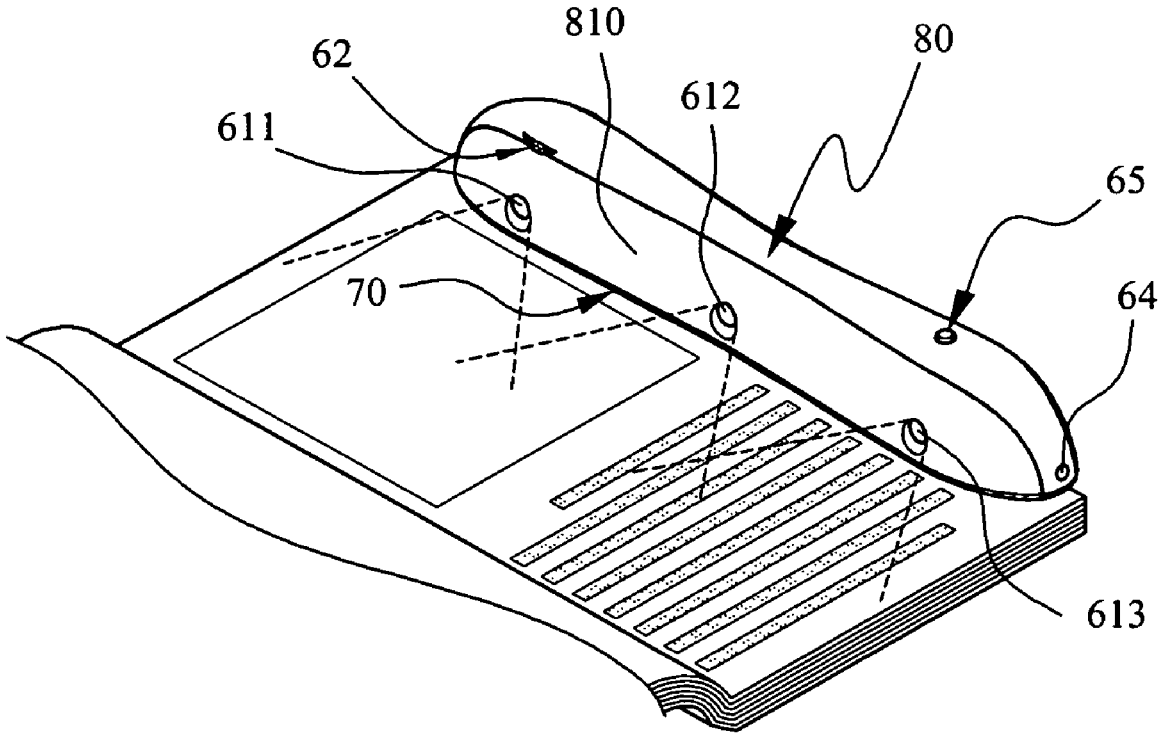
FIG. 12 shows the use of the portable reading lamp of the present invention to illuminate a book for reading.

FIG. 11 shows a circuit diagram for a preferred embodiment of the portable reading lamp of the present invention. Please refer to FIGS. 11 and 12 at the same time. To use the portable reading lamp of the present invention in reading a book or a magazine, first switch on the switch unit 62 for the light-emitting units 611, 612, and 613 to emit light and thereby illuminate a specific area on the book or the magazine being read. As can be seen from FIG. 11, the portable reading lamp is internally provided with a variable resistor 66 for controlling current level. By means of the variable resistor 66, a user may adjust the light-emitting units 611, 612, and 613 to different brightness according to the actual reading environment. When the reading environment is very dark, the variable resistor 66 may be adjusted to increase current and accordingly, increasing the brightness of the light-emitting units 611, 612, and 613. Otherwise, the variable resistor 66 may be adjusted to reduce the current and accordingly, reducing the brightness of the light-emitting units 611, 612, and 613.

Figure 13:
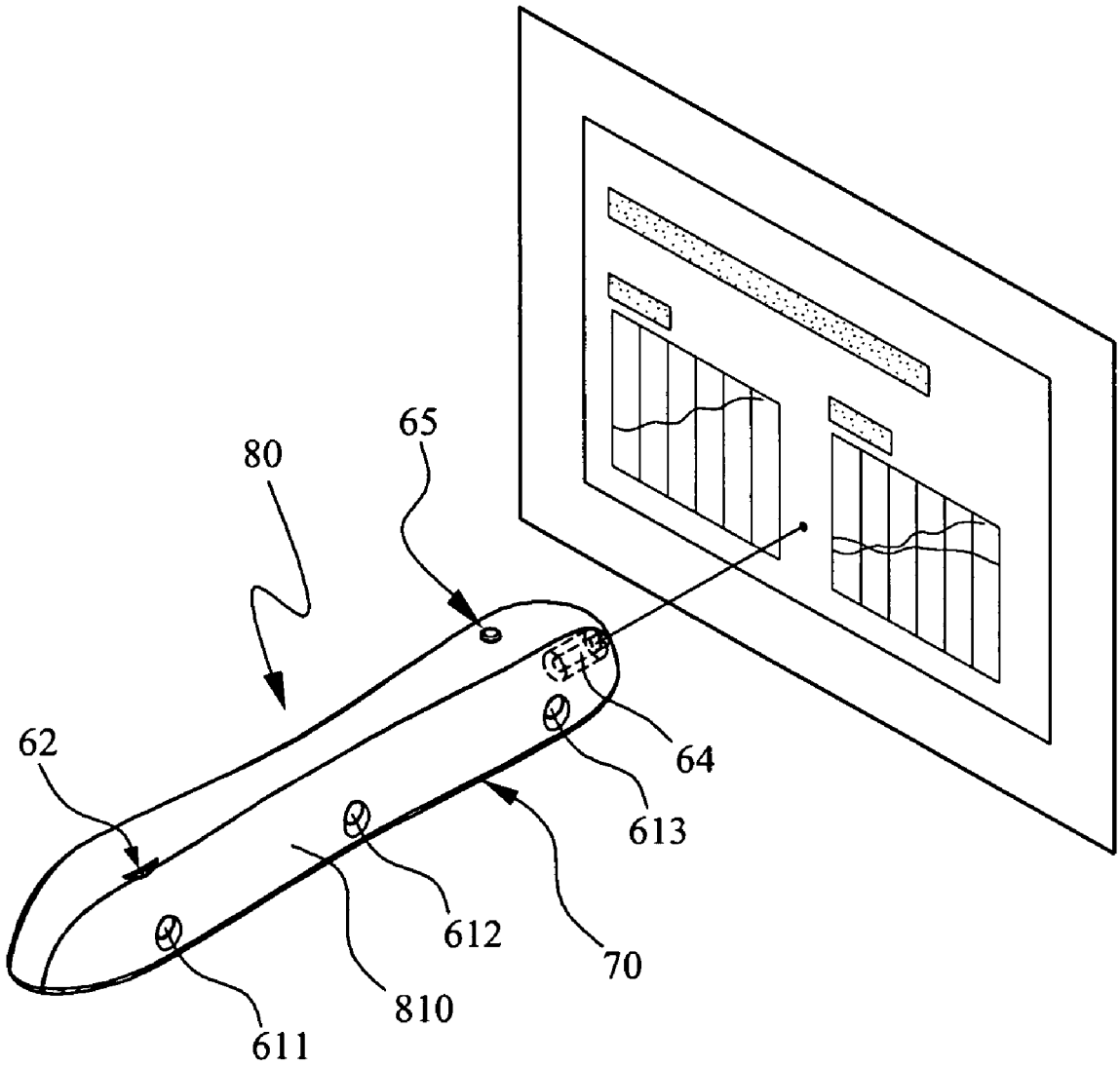
FIG. 13 shows the use of the portable reading lamp of the present invention as a laser pointer.
Figure 14:
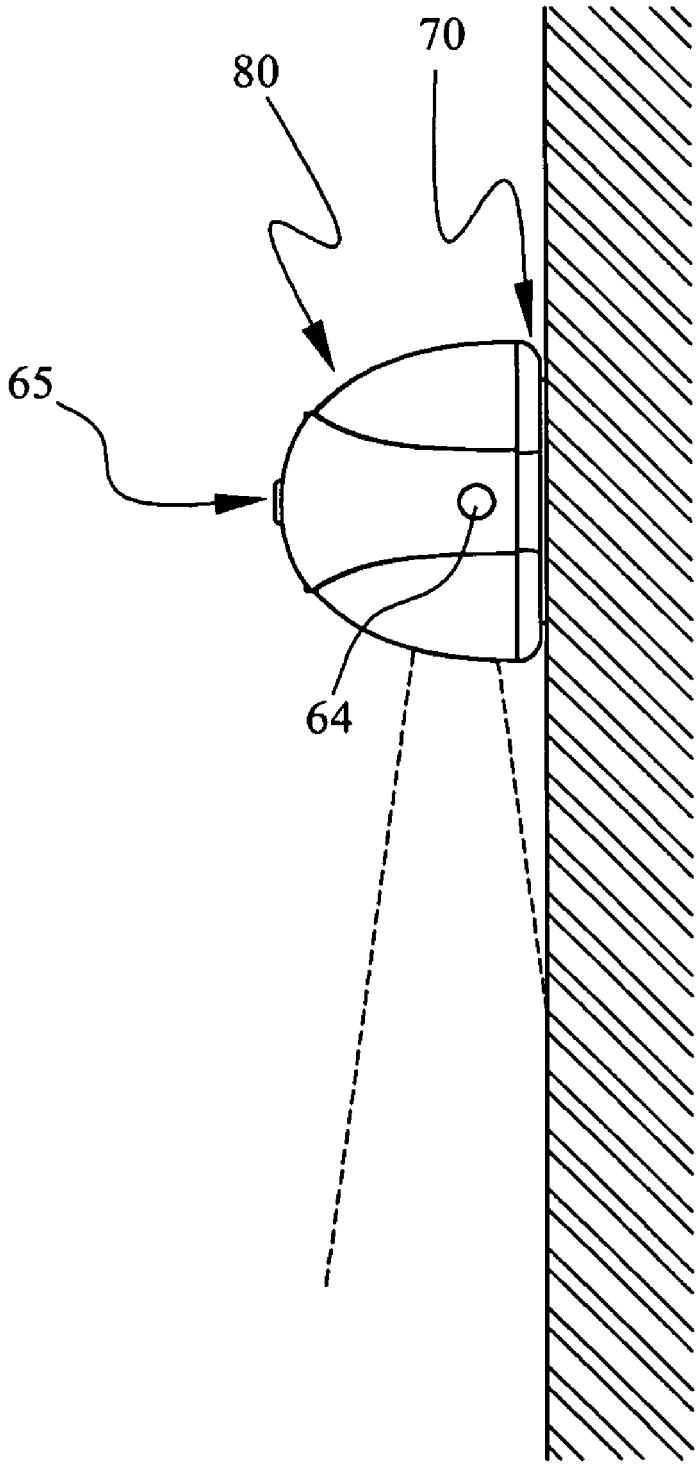
FIG. 14 shows the portable reading lamp of the present invention is magnetically attached to a whiteboard.

Please refer to FIGS. 10 and 13. The push button 652 of the switch assembly 65 can be pushed to turn on the laser-illuminating unit 64. At this point, the laser-illuminating unit 64 emits a convergent beam, enabling the portable reading lamp of the present invention to be also used as a laser pointer. Referring to FIG. 14, with the magnets 100, the portable reading lamp can be magnetically attached to a whiteboard or a metal surface of a domestic electric appliance to serve as a magnetic memo holder in daily life or in working.

With the light-guiding plate omitted therefrom, the portable reading lamp of the present invention has a largely reduced size and can be more conveniently carried around for use at different places. Also, with the curved lighting surface 810, the portable reading lamp of the present invention is able to irradiate and concentrate light onto a specific area to enable enhanced illumination. Moreover, the elongated and curved configuration makes the portable reading lamp of the present invention easy to hold without the risk of slipping off from a user's hand.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A portable reading lamp, comprising:

a printed circuit board (PCB) with a predetermined circuit layout provided thereon;

a lower cover located below the PCB;

an upper cover assembled to a top of the lower cover to enclose the PCB in and between the lower and the upper cover;

a plurality of light-emitting units spaced on one side of the PCB to electrically connect to the PCB; and a switch unit and a power supply unit provided on the PCB to electrically connect to each other; and the lower cover having an elongated configuration with two long sides thereof formed into two concaved surfaces, and being internally provided with fixing members for fixing the PCB to an inner side of the lower cover;

the upper cover also having an elongated configuration corresponding to that of the lower cover, and being formed with a plurality of holes corresponding to the light-emitting units as well as two opposite slits corresponding to the switch unit, such that the light-emitting units are respectively aligned with and confined in one corresponding hole and the switch unit is aligned with and confined between the two slits; and the assembled upper cover and lower cover together defining a front surface formed into an inward curved lighting surface, from where the light-emitting units irradiating light onto a predetermined area.

2. The portable reading lamp as claimed in claim 1, wherein the inward curved lighting surface is a concaved surface of about 2 to 5 degrees.

3. The portable reading lamp as claimed in claim 1, wherein the switch unit is composed of an adjustable switch and a disk assembled to the adjustable switch with a screw, and wherein the two slits formed on the upper cover are two symmetrical curved slits corresponding to the disk.

4. The portable reading lamp as claimed in claim 1, wherein the light-emitting units are light-emitting diodes (LEDs).

5. The portable reading lamp as claimed in claim 1, wherein the power supply unit includes two leaf springs in contact with a plurality of batteries, and the upper cover is formed on an inner surface near two ends thereof with two narrow recesses, such that the two leaf springs are separately fixedly inserted into the two narrow recesses.

6. The portable reading lamp as claimed in claim 5, wherein the lower cover is internally provided with a partition plate to separate the PCB from the batteries, and the upper cover is internally provided with a retaining plate extended between the two narrow recesses, such that the partition plate and the retaining plate together define a battery compartment, in which the batteries are received.

7. The portable reading lamp as claimed in claim 6, wherein the lower cover is formed at a bottom with an opening, via which the batteries can be moved into and out of the battery compartment; and a cover plate having a size corresponding to that of the opening being connected to the lower cover to openably close the opening.

8. The portable reading lamp as claimed in claim 1, wherein the power supply unit is a rechargeable power supply.

9. The portable reading lamp as claimed in claim 1, further comprising a laser-illuminating unit electrically connected to the PCB and a switch assembly for switching on and off the laser-illuminating unit; the laser-illuminating unit and the switch assembly being arranged at an end of the PCB opposite to the switch unit; and the upper cover being formed with fixing holes corresponding to the laser-illuminating unit and the switch assembly, such that the laser-illuminating unit and the switch assembly are separately aligned with and confined in the fixing holes.

10. The portable reading lamp as claimed in claim 9, wherein the switch assembly is composed of a push switch and a push button.

11. The portable reading lamp as claimed in claim 10, wherein the push button includes a key in the form of a circular boss and a plurality of radially outward extended and beveled locating teeth spaced around the key; and the locating teeth preventing the push button from angularly displacing when the key is downward pushed.

12. The portable reading lamp as claimed in claim 9, wherein the laser-illuminating unit is a laser diode.

13. The portable reading lamp as claimed in claim 1, wherein the lower cover is provided on an underside of its bottom near two ends thereof with a magnet each.

* * * * *

UNITED STATES PATENT AND TRADEMARK OFFICE

CERTIFICATE OF CORRECTION

PATENT NO. : 7,604,366 B1
APPLICATION NO. : 12/141750
DATED : October 20, 2009
INVENTOR(S) : Chen It is certified that error appears in the above-identified patent and that said Letters Patent is hereby corrected as shown below:

Title Page:
Item (73), should read:

Item (73) Assignee: Lionbook Technology Ltd., Miaoli City, Miaoli County (TW)

Signed and Sealed this

Fifth Day of January, 2010

David J. Kappos

David J. Kappos
*Director of the United States Patent and Trademark Office*